US006705985B2

(12) United States Patent
Easter et al.

(10) Patent No.: US 6,705,985 B2
(45) Date of Patent: Mar. 16, 2004

(54) APPARATUS AND METHOD FOR OSSICULAR FIXATION OF IMPLANTABLE HEARING AID ACTUATOR

(75) Inventors: James Roy Easter, Lyons, CO (US); James Frank Kasic, II, Boulder, CO (US); José H. Bedoya, Boulder, CO (US)

(73) Assignee: Otologics LLC, Boulder, CO (US)

( * ) Notice: Subject to any disclaimer, the term of this patent is extended or adjusted under 35 U.S.C. 154(b) by 0 days.

(21) Appl. No.: 09/991,398

(22) Filed: Nov. 20, 2001

(65) Prior Publication Data

US 2003/0065245 A1 Apr. 3, 2003

Related U.S. Application Data

(60) Provisional application No. 60/326,124, filed on Sep. 28, 2001.

(51) Int. Cl.[7] ..... H04R 25/00
(52) U.S. Cl. ..... 600/25
(58) Field of Search ..... 600/25; 439/668; 607/57; 623/10

(56) References Cited

U.S. PATENT DOCUMENTS

| | | | | | |
|---|---|---|---|---|---|
| 3,764,748 | A | * | 10/1973 | Branch et al. | 607/57 |
| 4,287,616 | A | | 9/1981 | Heimke et al. | 3/1.9 |
| 4,462,401 | A | | 7/1984 | Burgio | 128/303 |
| 4,462,402 | A | | 7/1984 | Burgio et al. | 128/303 |
| 4,487,210 | A | | 12/1984 | Knudsen et al. | 128/785 |
| 4,498,461 | A | | 2/1985 | Håkansson | 128/1 |
| 4,774,933 | A | | 10/1988 | Hough et al. | 600/25 |
| 4,904,233 | A | | 2/1990 | Håkansson et al. | 600/25 |
| 5,085,628 | A | | 2/1992 | Engebretson et al. | 600/25 |
| 5,144,952 | A | | 9/1992 | Frachet et al. | 128/642 |
| 5,220,918 | A | | 6/1993 | Heide et al. | 128/420.6 |
| 5,460,593 | A | * | 10/1995 | Mersky et al. | 600/25 |
| 5,486,197 | A | | 1/1996 | Le et al. | 606/232 |
| 5,527,342 | A | | 6/1996 | Pietrzak et al. | 606/232 |
| 5,584,695 | A | | 12/1996 | Lal Sachdeva et al. | 433/173 |
| 5,702,342 | A | * | 12/1997 | Metzler et al. | 600/25 |
| 5,720,631 | A | * | 2/1998 | Carson et al. | 439/668 |
| 5,735,790 | A | | 4/1998 | Håkansson et al. | 600/25 |
| 5,788,711 | A | | 8/1998 | Lehner et al. | 606/130 |
| 5,840,078 | A | | 11/1998 | Yerys | 606/151 |
| 5,904,483 | A | | 5/1999 | Wade | 433/173 |
| 5,935,170 | A | | 8/1999 | Håkansson et al. | 623/16 |
| 5,951,601 | A | | 9/1999 | Lesinski et al. | 623/10 |
| 5,984,859 | A | * | 11/1999 | Lesinski | 600/25 |
| 6,039,685 | A | | 3/2000 | Bushek | 600/25 |
| 6,277,148 | B1 | * | 8/2001 | Dormer | 623/10 |
| 2002/0095063 | A1 | * | 7/2002 | Kroll et al. | 600/25 |

* cited by examiner

*Primary Examiner*—Eric F. Winakur
*Assistant Examiner*—Nikita R Veniaminov
(74) *Attorney, Agent, or Firm*—Marsh Fischmann & Breyfogle LLP

(57) ABSTRACT

The invention is directed to a fixation apparatus and method for interfacing an implantable hearing aid actuator with the ossicular chain of a patient. The fixation apparatus may include one or more surface discontinuities to enhance tissue fixation and thereby yield enhanced mechanical coupling and vibratory response. Surface discontinuities may be in the form of surface pores, surface asperities and complex surface shapes such as grooves, slots, lips or openings formed in the fixation apparatus. The fixation apparatus may also and/or alternatively include a portion or component that is deflectable or that comprises a conditioned shape memory material that is activatable at bodily temperatures to yield a degree of lateral loading when the fixation apparatus is positioned within an opening defined within a bone of the ossicular chain of a patient, thereby yielding enhanced mechanical coupling.

42 Claims, 8 Drawing Sheets

APPARATUS AND METHOD FOR OSSICULAR FIXATION OF IMPLANTABLE HEARING AID ACTUATOR

RELATED APPLICATION

This application claims priority from U.S. Provisional Patent Application Serial No. 60/326,124, filed on Sep. 28, 2001, which is incorporated herein by reference.

FIELD OF THE INVENTION

The present invention relates to an apparatus and method for interfacing an implantable hearing aid system with a patient's auditory system, and more particularly, to a fixation apparatus and method which yields enhanced energy transfer between an implantable actuator and the ossicular chain of a patient.

BACKGROUND OF THE INVENTION

Fully-implantable and semi-implantable hearing aid systems typically employ some form of actuator to stimulate the ossicular chain and/or tympanic membrane in the middle ear of a patient. By way of primary example, implantable actuators may comprise an electromechanical transducer having a vibratory member positioned to mechanically stimulate the ossicular chain via axial vibrations communicated therebetween (see e.g. U.S. Pat. No. 5,702,342).

As may be appreciated, the utilization of an implantable hearing aid actuator of the above-noted nature entails surgical positioning of the actuator within the mastoid process of a patient's skull. Such positioning typically requires the insertion of the actuator through a hole drilled in the mastoid process. Then, a distal end of an interconnected vibratory member is located immediately adjacent to a desired location along the ossicular chain (e.g. the incus).

In conjunction with such placement, the present inventors have recognized the importance of achieving a high degree of mechanical coupling between the vibratory member of an actuator and the ossicular chain in order to optimize performance. More particularly, the inventors have recognized that mechanical coupling may be significantly enhanced by inducing tissue interconnection with a vibratory member after implantation and/or by providing a degree of lateral loading between the vibratory member and ossicular chain. In turn, energy transfer is improved, thereby enhancing a patient's assisted hearing.

SUMMARY OF THE INVENTION

In view of the foregoing, a general objective of the present invention is to provide a hearing aid apparatus and method that improves mechanical coupling between the vibratory member of an implantable actuator and the ossicular chain of a patient.

A related objective of the present invention is to provide for improved ossicular coupling by enhancing tissue interconnection between an implantable vibratory member and the ossicular chain of a patient.

Another related objective of the present invention is to provide for improved ossicular coupling by achieving a degree of lateral loading between an implantable vibratory member and the ossicular chain of a patient.

Yet a further related objective of the present invention is to provide for improved ossicular coupling in a manner that is relatively easy and inexpensive to implement.

One or more of the above objectives and additional advantages may be realized by an inventive fixation apparatus that comprises a proximal end for interconnection to a vibratory member of an implantable hearing aid actuator and a distal end for issue interconnection with, and preferably direct physical contact with some member of the ossicular chain of a patient (e.g. the incus). The fixation apparatus further includes a body portion extending between the proximal end and the distal end.

In one aspect of the invention, the body portion of the fixation apparatus may comprise at least one surface discontinuity for inducing patient tissue attachment thereto after implantation of the fixation apparatus. Such discontinuity may be defined by surface pores and/or surface asperities and/or by one or more complex surfaces such as grooves, depressions, holes, slots, recesses or the like at the distal end or along the body portion of the fixation apparatus.

In one arrangement, the fixation apparatus may be fabricated utilizing a biocompatible material that yields surface pores and/or asperities, such pores or asperities being of a size sufficient to permit tissue infiltration after implantation. For such purposes, and by way of example only, the fixation apparatus may comprise a ceramic material (e.g. aluminumoxide), a plastic material (e.g. polytetrafluroethylene (PTFE), polyethylene or polydimethylsiloxane), or a composite material (e.g. PTFE—carbon fiber, PTFE—aluminumoxide, or aluminum oxide—zirconium). Such materials may be integrally molded into or otherwise coated over a core body to define the fixation apparatus. In the later regard, examples of preferable outer coating materials include hydroxyapatite, hydroxyapatile in an elastomeric matrix, or tricalciumphosphate with fibrigen glue.

As noted above, complex surface shapes may also advantageously define one or more surface discontinuities. In one arrangement, at least one slot may be provided which extends across the distal end and rearwardly through part of the body portion of the fixation apparatus. In a related arrangement, two transverse slots may be provided which extend from the distal end rearwardly through a part of the body portion. In an additional embodiment, a recessed ring may be defined around the body portion.

In yet a further arrangement, the body portion of the fixation apparatus may comprise one or more pairs of adjacent enlarged and reduced sections, wherein corresponding lip portions are defined therebetween. By way of example, the body portion may comprise a first frusto-conical section which proximally adjoins an adjacent reduced section (e.g., a cylindrical section), thereby defining an annular, stepped-down lip therebetween. In another arrangement, two frusto-conical sections may defined within the body portion with a reduced body section proximally located adjacent to each of the frusto-conical sections to define two corresponding lips. As may be appreciated, the utilization of configurations which define stepped-down lips from a distal end to proximal end perspective serves to enhance long term coupling since tissue growth which occurs after implantation adjacent to the lip portions will restrict undesired retraction (e.g., rearward movement) of the fixation apparatus.

In a related aspect of the present invention, the body portion of the fixation apparatus may comprise one or more tapered surfaces which angle outwardly from the distal end. Such a configuration facilitates insertion of the distal end into an opening defined at a desired location along the ossicular chain of a patient, thereby yielding an arrangement in which the distal end of the fixation apparatus may actually be seated within the ossicular opening to enhance mechanical coupling therebetween. Further, the noted arrangement facilitates removal, or disengagement, of the fixation device from the ossicular chain if so desired. Additionally, in certain arrangements a degree of outward, or lateral, loading on the sidewalls of the ossicular opening may be realized.

In yet another aspect of the present invention at least a subportion of the body portion of the fixation apparatus may be oriented so that a center axis thereof is not coaxially aligned with a center axis of an opening defined at a desired interface location along the ossicular chain of a patient. Further, at least the subportion of the body portion may comprise a material that resiliently accommodates a degree of deflection so that, upon insertion of the distal end of the fixation apparatus into the ossicular opening, the body portion contacts a sidewall of the ossicular opening and is deflected to apply an outward, or lateral, loading on the sidewalls of the ossicular opening. In this regard, it is preferable that the body portion be provided so that, during insertion of the distal end into an ossicular opening, a ratio of the axial force to radial force applied at the ossicular opening site is maintained at less than about 10 to 1; preferably with no more than about 1.2 grams of axial force being applied. In the latter regard, after inserted placement of the distal end, substantially no axial force should be applied at the ossicular opening, while application of the lateral loading force should continue, thereby yielding enhanced coupling. To achieve the desired functionality, at least the noted subportion of the fixation apparatus may comprise a material having a modulus of elasticity in tension of at least about $1\times10^7$ psi. By way of example, the subportion of the body portion may comprise a metal such as a titanium, a titanium alloy, (e.g. nickle titanium), hardened platinum (e.g. cold-worked), a platinum alloy (e.g. platinum iridium), or a gold-plated stainless steel. Of note, a metallic core body may also be utilized with a ceramic material coating for tissue attachment purposes as referenced above.

When one or more slots are provided as described above, two or more leg members may each correspondingly define deflectable distal subportions of the body portion. Further, the distal outer surfaces of each of the leg members may be tapered as noted above. More particularly, the distal end of the fixation apparatus may have a maximum cross-dimension, (i.e. diameter) that is less than the minimum cross-dimension of a defined ossicular opening, while the distal outer tapered surfaces of the leg members may combinatively define a maximum cross dimension that is greater than the maximum cross-dimension of the ossicular opening. As such, upon insertion of the distal ends of the leg members into the ossicular opening the leg members may contact the internal sidewalls and gradually deflect inward toward a center axis of the fixation apparatus to yield lateral loading for enhanced mechanical coupling. Additionally, the outer surfaces of one or more of the leg members may be defined to angle outwardly from the proximal end of the fixation apparatus to an adjoinment region with a corresponding tapered surface at the distal end. Such a configuration may be utilized to increase the magnitude of outward mechanical loading per unit distance of distal end insertion into an ossicular opening.

In yet another aspect of the present invention, at least a subportion of the body portion may comprise a shape memory material such as titanium or a titanium alloy (e.g. nickel titanium). The subportion maybe advantageously conditioned for automatic activation at temperatures above predetermined minimum body temperature. More particularly, upon activation the body subportion may be provided to change from a first configuration to a second configuration, wherein lateral loading within an ossicular opening may be readily achieved.

In one arrangement, a distal end slot may define opposing leg members in the body portion, each of which leg members comprise a shape memory material. Upon activation, the opposing leg members are conditioned to collectively change from a closed, or collapsed, V-shape configuration to an opened, or expanded, V-shape configuration. As may be appreciated, activation may be automatically realized after surgical placement as the fixation apparatus is heated to bodily temperatures.

In a related aspect of the present invention, a fixation apparatus may comprise a spring member fabricated from a shape memory material. In turn, the body portion of the fixation apparatus may be sized to receive the spring member and adapted to be deflectable from a first configuration to a second configuration upon activation of the spring member. By way of example, a shape memory spring member may be disposed within a slot extending across and rearwardly from the distal end of a fixation apparatus, wherein activation of the spring member (e.g. upon heating to bodily temperatures after surgical placement) laterally deflects opposing leg members outwardly to achieve a degree of lateral loading within an ossicular opening.

In view of the foregoing, it may be appreciated that the present invention also contemplates an inventive method for enhancing ossicular coupling of an implantable hearing aid actuator. The method includes the step of defining an opening in the ossicular chain of a patient (i.e. via laser ablation). The method further includes the step of positioning the distal end of a fixation apparatus into ossicular opening. In conjunction with such positioning the method may further entail the application of a lateral loading force by the fixation apparatus to the internal sidewalls of the defined opening to yield enhanced mechanical coupling therebetween. Alternatively and/or additionally, the method may provide for inducing tissue interconnection between a fixation apparatus and ossicular site by providing surface pores, surface asperities and/or complex surface shapes along the body portion.

As will be understood, the inventive method may utilize a fixation apparatus comprising one or more of the above-noted features. In particular, the ossicular opening may be defined to be slightly larger than the distal end of the fixation apparatus, and the body portion may comprise outer surfaces which taper outwardly from the distal end. Further, one or more slots may be provided at the distal end of the fixation apparatus so as to define two or more leg members. In turn, the inventive method may include the step of axially advancing the distal end into an ossicular opening, wherein one or more of the leg members contacts a sidewall in the opening and is deflected towards a center axis of the fixation apparatus to achieve lateral loading.

In another approach the inventive method may further provide for lateral loading at an ossicular opening site via activation of a shape memory material. For example, at least a subportion of a body portion of the fixation apparatus may be provided that is activatable at a minimum body temperature to change from a first configuration to a second configuration, wherein the body portion contacts the internal sidewalls at an ossicular opening when activated to apply a lateral loading force thereto.

In yet another approach, a shape memory spring member may be located about or within a distal end slot of the body portion of a fixation apparatus and actuated at a minimum body temperature to change from a first to second configuration. Upon activation, the spring may contact and displace the body portion to apply a lateral loading force to the internal sidewalls of an ossicular opening.

Additional aspects and advantages of the present invention will be apparent to those skilled in the art upon review of the further description that follows:

DETAILED DESCRIPTION

Figure 1:
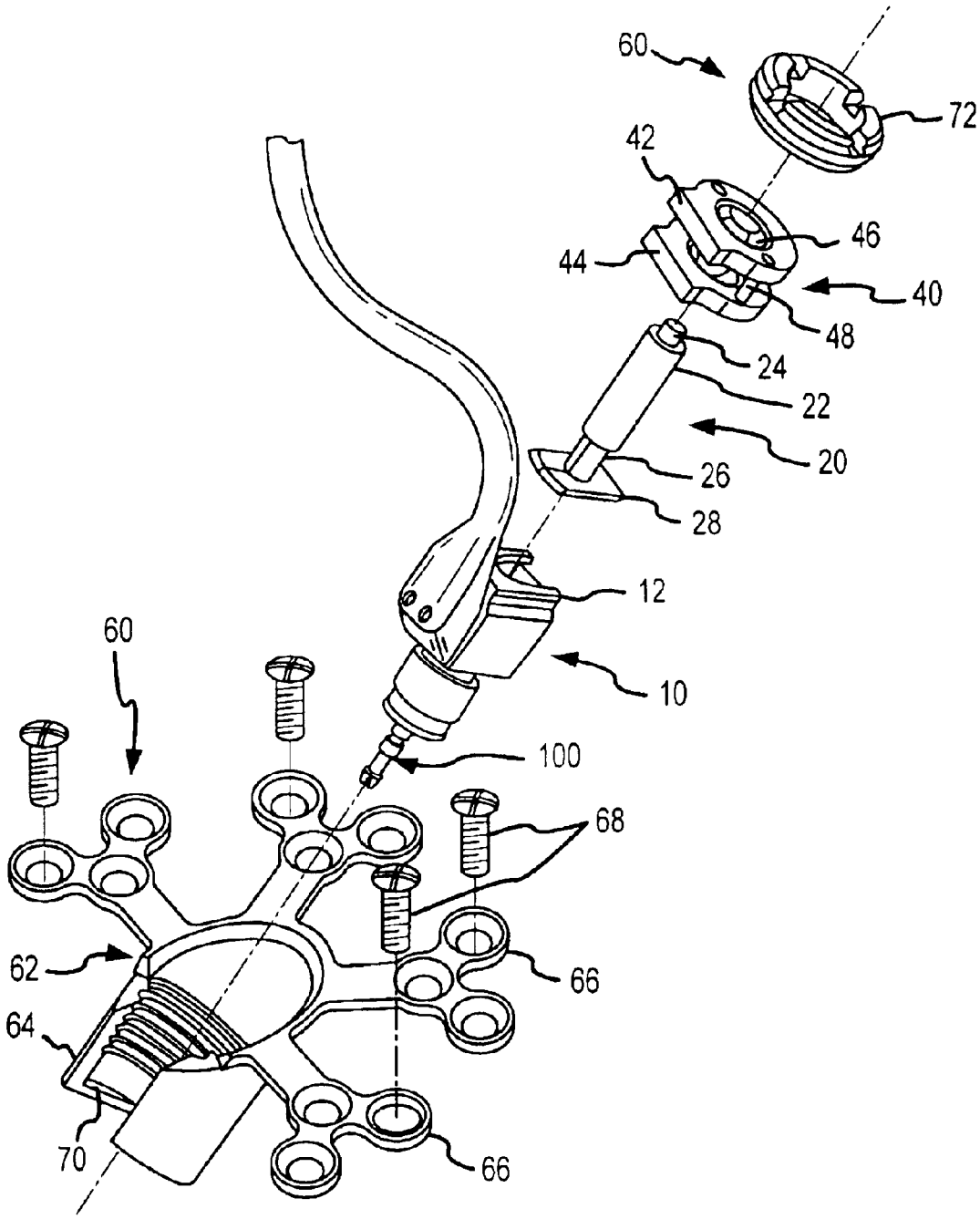
FIG. 1 illustrates one embodiment of a fixation apparatus implemented with an exemplary implantable hearing aid actuator.
Figure 2:
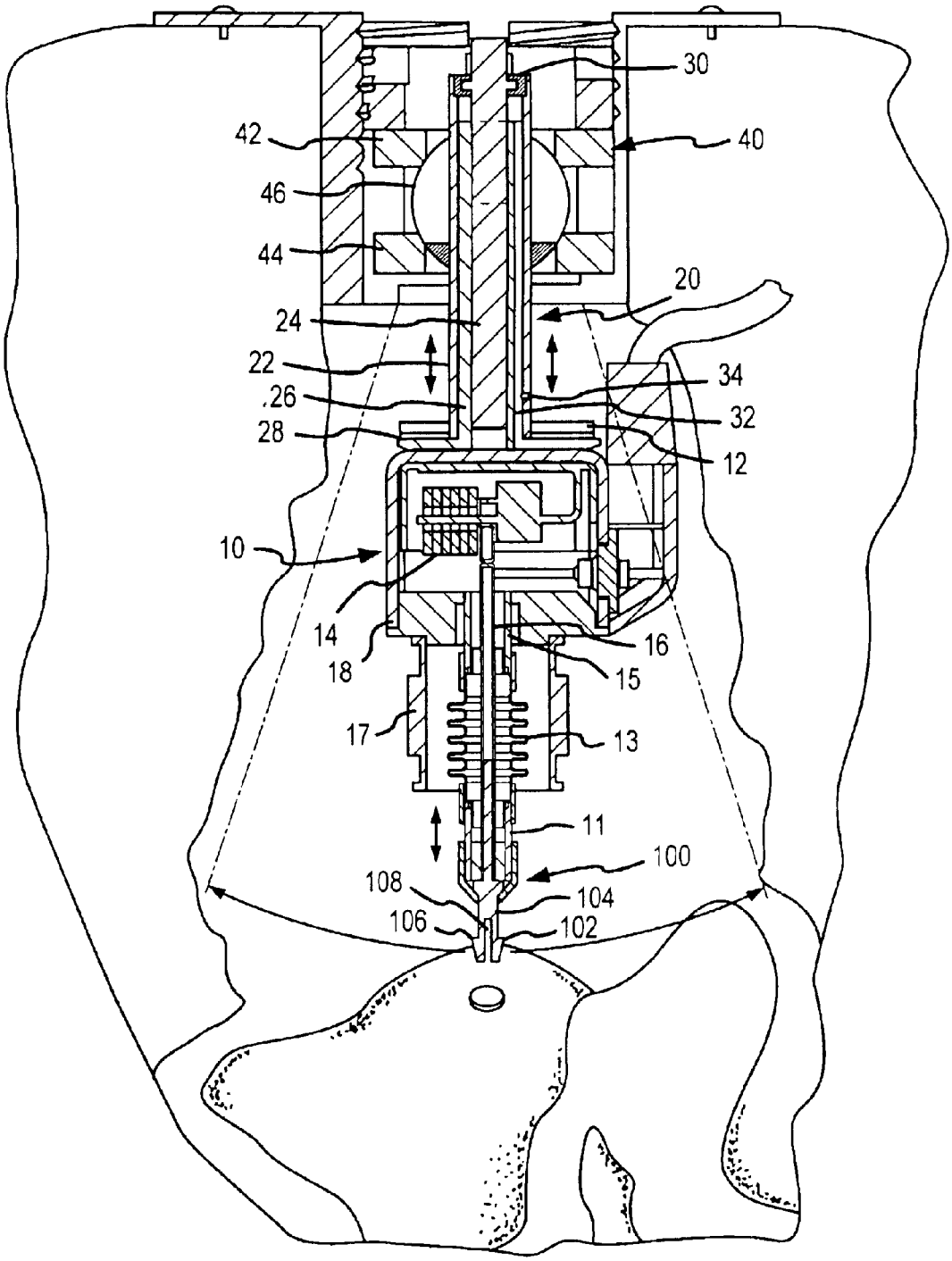
FIG. 2 illustrates in cross-section the exemplary implantable hearing aid actuator of FIG. 1 as positioned within the mastoid process of a patient.

FIGS. 1 and 2 illustrate one embodiment of a fixation apparatus 100 comprising the present invention as implemented with an exemplary implantable hearing aid actuator 10. In the latter regard, the exemplary actuator 10 may be utilized with a carrier assembly 20, swivel assembly 40 and mounting assembly 60 to achieve the desired positioning of fixation apparatus 100 within the mastoid process of a patient. Generally, exemplary actuator 10 may be supportably connected to one end of the carrier assembly 20 and carrier assembly 20 may be supportably received through the swivel assembly 40. The assembled carrier assembly 20/swivel assembly 40 may be supportably interconnected to the mounting assembly 60 when attached to a patient's skull.

More particularly, mounting assembly 60 may comprise a mounting apparatus 62 that includes a barrel portion 64 positionable through an opening formed in the mastoid process of a patient to yield access therethrough to the middle ear. A plurality of mounting legs 66 may be provided at the top end of barrel portion 64 and employed with attachment screws 68 to interconnect the mounting apparatus 62 to a patient's skull.

The carrier assembly 20 may comprise an outer support member 22, an inner-shaft member 24 and a telescoping member 26 having a foot-like bottom end 28 for slidable insertion into a channel 12 provided at the top end of exemplary actuator 10. The inner-shaft member 24 may be threaded on an outside surface for driven engagement with a threaded internal surface of the telescoping member 26. A bushing 30 may be disposed in the top end of the outer support member 22 so as to axially fix the inner-shaft member 24 relative to the outer support member 22 but allow inner-shaft member 24 to be rotated relative to the outer support member 22, e.g., via driven engagement by an accessory tool at the top end of the inner-shaft member 24. Telescoping member 26 may include an outer groove 32 extending along the length thereof to co-act with a restraining pin 34 projecting inward from the outer support member 22. As such, when the outer support member 22 is fixed relative to swivel assembly 40 (as will be further described), inner-shaft member 24 may be rotated at its top end so that the telescoping member 26 and exemplary actuator 10 interconnected thereto and may be selectively advanced/retracted relative to the outer support member 22.

As noted, carrier assembly 20 may be supportably interconnected to swivel assembly 40. In this regard, swivel assembly 40 may include opposing top and bottom plate members 42 and 44 which are adjoined to capture a rotatable ball member 46 therebetween. The plate members 42, 44, and ball member 46 include apertures through which carrier assembly 20 may be slidably received. The top and bottom plate members 42, 44 may be interconnected via pins 48 in a manner that allows the ball member 46 to rotate relative to the top and bottom plate members 42, 44, absent the application of a compressive force on swivel assembly 40. In the event that a compressive force is applied, the top and bottom plate members may be provided so as to secure the ball member 46 in a fixed position. Further in this regard, ball member 46 may be provided with a plurality of slits so that upon the application of a compressive force separated sections of the ball member 46 may be urged inward towards a center axis to secure the outer support member 24 of the carrier assembly 20 in an axially fixed position.

In view of the foregoing description, it will be understood that the exemplary actuator 10 can be supportably interconnected via slot 82 to carrier assembly 20. In turn, carrier assembly 20 may be slidably located through swivel assembly 40. Then, the interconnected exemplary actuator 10/carrier assembly 20/and swivel assembly 40 may be inserted into the top end of the mounting apparatus 62, whereupon the swivel assembly 40 may supportably rest upon a bottom support ledge 70 provided at the bottom end of the barrel portion 64 of mounting apparatus 62.

The interconnection between carrier assembly 20 and swivel assembly 40 provides for pivotable, lateral positioning of the footed end 28 of the carrier assembly 20 and of the actuator 10 interconnected thereto. Further, the carrier device 20 may be selectively secured at a continuum of positions relative to the swivel assembly 40, thereby facilitating advancement/retraction of the carrier assembly 20 and interconnected actuator 10 in a depth dimension. To lock in a given angular and linear position of carrier assembly 20 relative to swivel assembly 40, a locking member 72 may be threadable advanced in the top of the barrel portion 64 of the mounting apparatus 62 so as to apply a compressive force to the swivel assembly 40.

As shown in FIG. 2., the exemplary actuator may comprise an electromechanical transducer 14 with an interconnected vibratory member 16. The transducer 14 may be located within an outer housing 18 with the vibratory member 16 extending through an opening provided on one side of the housing 18. The distal end of the vibratory member is interconnected to a distal sleeve 11. In turn, a bellows member 13 that is interconnected to the distal sleeve 11 and a proximal sleeve 15 is interconnected to the transducer housing 18. By virtue of this arrangement, axial-vibrations can be communicated between vibratory member 16 and the ossicular chain of a patient, while maintaining isolation of the transducer 12 and other internal componentry of the actuator 10. Of note, the fixation apparatus 100 may be rigidly interconnected to the distal end of the vibratory member 16 for direct interface with the patient's ossicular chain.

Figure 3B:
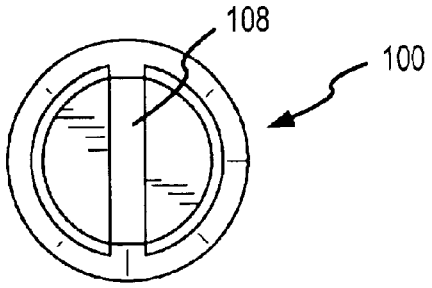
FIGS. 3A, 3B and 3C illustrate the side, top and perspective views, respectively, of the fixation apparatus embodiment shown in FIGS. 1 and 2.
Figure 3C:
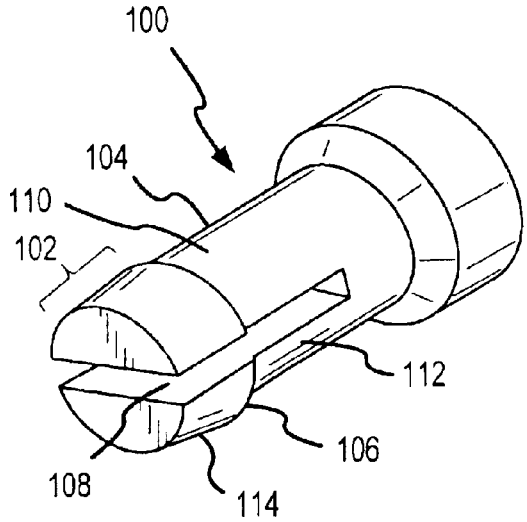
Figure 3A:
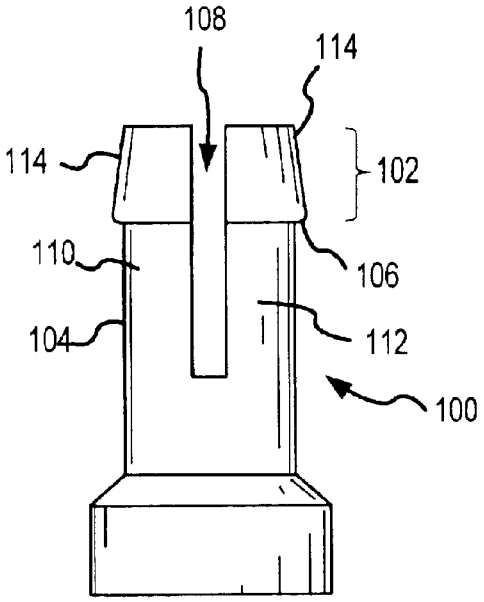
Figure 4:
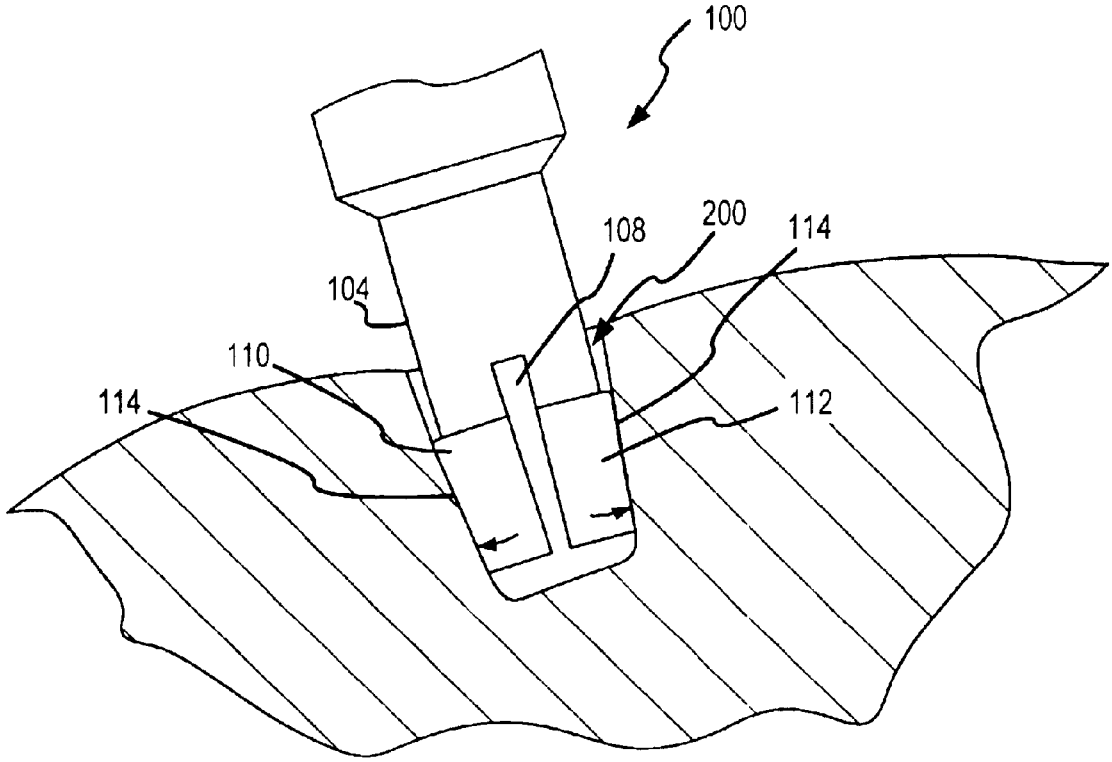
FIG. 4 illustrates the fixation apparatus embodiment shown in FIGS. 1, 2 and 3A–3C located within an opening defined in one member (e.g. the malleus) of the ossicular chain of a patient.

Fixation apparatus 100 is particularly adapted for achieving a high degree of mechanical coupling with a patient's ossicular chain. In particular, fixation apparatus 100 may comprise at least one surface discontinuity that induces patient tissue attachment thereto subsequent to surgical implantation. Such surface discontinuity may be defined in a number of different ways. In the embodiment shown in FIGS. 1 and 2, and as more clearly shown by FIGS. 3A–3C, one surface discontinuity comprises a first frusto-conical portion 102 adjoining a reduced main body portion 104 to define a protruding lip 106 therebetween. Another surface discontinuity is defined by slot 108 extending across and rearwardly from the distal end of the fixation apparatus embodiment 100. Slot 108 serves to define opposing leg members 110, 112. The noted surface discontinuities provide locations to which patient tissue may readily attach subsequent to surgical implantation, thereby enhancing mechanical coupling between the fixation apparatus 100 and a patient's ossicular chain.

In addition to the noted surface discontinuities, fixation apparatus 100 is capable of further enhanced mechanical coupling when advanced into a shallow opening 200 defined within one of the ossicular bones (e.g. an opening defined in the incus via laser ablation). In this regard, and referring now to FIGS. 3A–3C and FIG. 4, an opening 200 may defined in the ossicular bone and sized to be slightly greater in cross-dimension (e.g. diameter) than the corresponding cross-dimension size of the distal end of fixation apparatus 100. As such, upon advancement of fixation apparatus 100 into opening 200, the outwardly tapered surfaces 114 of leg members 110, 112 will engage and provide an outward, or lateral, loading force against the internal wall of the opening 200.

Further in this regard, the fixation apparatus 100 may comprise a biocompatible metal (e.g. titanium, a titanium alloy, platinum, a platinum alloy, or gold-plated stainless steel), wherein leg members 110, 112 may deflect inwardly (e.g. towards a center axis of fixation apparatus 100) upon contact insertion into opening 200 to achieve a degree of lateral loading. Additionally, it may be desirable to define the leg members 110, 112 so that, during axial advancement into the ossicular opening 200 a ratio of the axial force applied to resultant lateral loading force achieved is about 10 to 1 or less; preferably with axial load maintained at less than about 1.2 grams. For such purposes, leg members 110, 112 may preferably comprise a material having a modulus of elasticity in tension of at least about $1\times10^7$.

In an alternative embodiment, one or both of the leg members 110, 112 may comprise a shape memory alloy that is conditioned to be actuated at bodily temperatures so that one or both of the distal ends of leg members 110, 112 move away from each other to apply lateral loading within the ossicular opening 200 after surgical placement. As may be appreciated, in such an arrangement leg members 110, 112 need not be provided with outwardly tapered surfaces 114 for engaging the internal sidewalls of ossicular opening 200, and axial loading during insertion into ossicular opening 200 need not be applied to achieve the desired degree of lateral loading. Rather, such loading may be defined in direct relation to the shape memory attributes of the material comprising the leg members 110, 112.

In addition to the surface discontinuities as noted above, fixation apparatus may further be constructed of a material or in a manner that yields an outer surface having pores or asperities for the infiltration of and interconnection of tissue subsequent to implantation. To achieve such pores, a ceramic, plastic or composite material may be utilized to fabricate fixation apparatus 100 as an integral, one-piece device. Alternatively, fixation apparatus 100 may be defined by a metallic core body, with a ceramic, plastic or composite material coating.

Returning now to the implementation of FIGS. 1 and 2, an implantation procedure utilizing fixation apparatus 100 will be briefly summarized. Initially, an opening may be defined in the mastoid process of a patient via drilling. Similarly, an ossicular opening 200 may be defined at a desired location. Thereafter, barrel portion 64 of the mounting apparatus 62 may be inserted through the mastoid process opening. The mounting apparatus 62 may be then secured in a desired position on the skull via the insertion of screws 68 through apertures provided in radiating mounting legs 66.

Following connection of the mounting apparatus 62, the exemplary actuator 10, carrier assembly 20 and swivel assembly 40 may be positioned (e.g., as a unit) within the mounting apparatus 62. In this regard, the opening defined through swivel assembly 40 may be sized for slidable receipt of the outside surface of support member 24 of the carrier assembly 20, so as to allow relative axial positioning of carrier assembly 20. More particularly, an accessory tool (not shown) may be utilized to selectively advance/retract the carrier assembly 20 and interconnected actuator 10 relative to the swivel assembly 40. Additionally, the angular position of the exemplary actuator 10 may be selectively set via use of the accessory tool to affect the movement of the carrier assembly 20 and rotation of ball member 46 relative to the top and bottom plate members 42, 44, of the swivel assembly 40. The actuator is positioned so that fixation apparatus 100 is directed towards and within a predetermined distance range of the ossicular opening 200. Then, the locking ring 72 may be advanced within the barrel portion 64 of the mounting apparatus so as to lock in the set angular orientation and depth setting of the carrier assembly 20. To further advance the fixation apparatus 100, an additional accessory tool may be inserted through locking ring 72 to engage the top end of the inner-shaft 24 of the carrier assembly 20 for driven rotation thereof. In this regard, the threading of the inner-shaft member 26 and telescoping member 28 may be defined so that, for a amount of given rotation of the top end of inner-shaft member 26, a corresponding predetermined linear travel of the telescoping shaft member 28 will be affected. The linear advancement of fixation apparatus 100 into the ossicular opening 200 may therefore be carried out to establish a degree of lateral loading as described above. After positioning of the fixation apparatus 100, placement of and connections between other implanted components of a given hearing aid system may be completed.

Figure 5B:
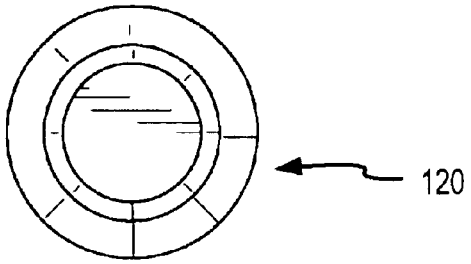
FIGS. 5A, 5B and 5C illustrate side, end and perspective views, respectively, of an alternate fixation apparatus embodiment.
Figure 5C:
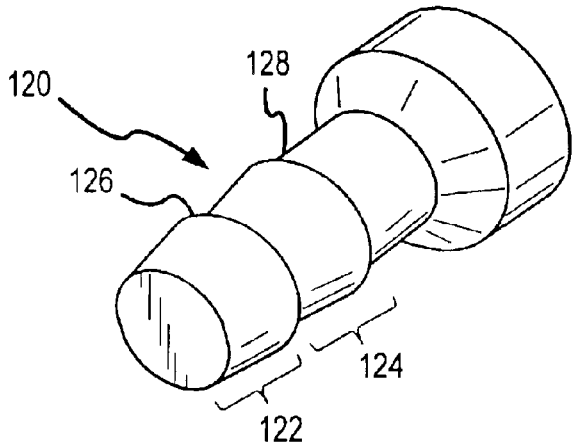
Figure 5A:
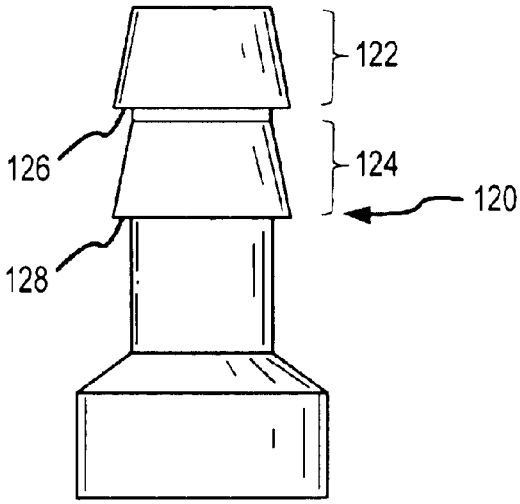

FIGS. 5A–5C, 6A–6C, 7A–7D and 8A–8D illustrate further fixation apparatus embodiments. In the fixation apparatus embodiment 120 shown in FIGS. 5A–5C, first and second frusto-conical portions 122 and 124 are provided with a segment 126 interposed therebetween. As illustrated, two stepped-down lips 128 and 130 are defined in this embodiment for tissue interconnection.

Figure 6B:
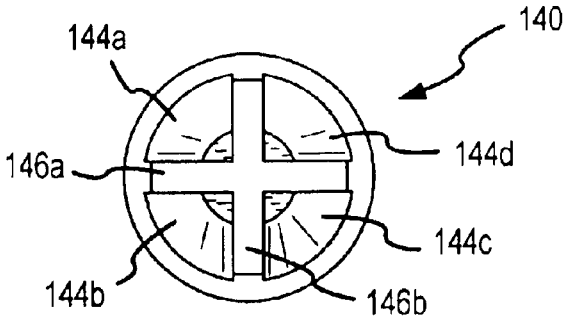
FIGS. 6A, 6B and 6C illustrate side, end and perspective views, respectively, of yet another fixation apparatus embodiment.
Figure 6C:
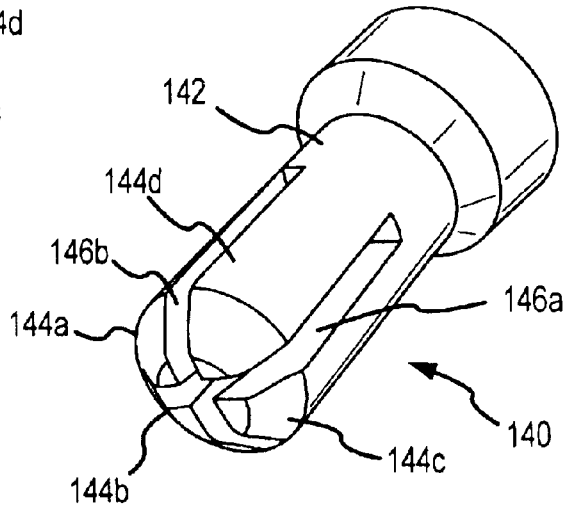
Figure 6A:
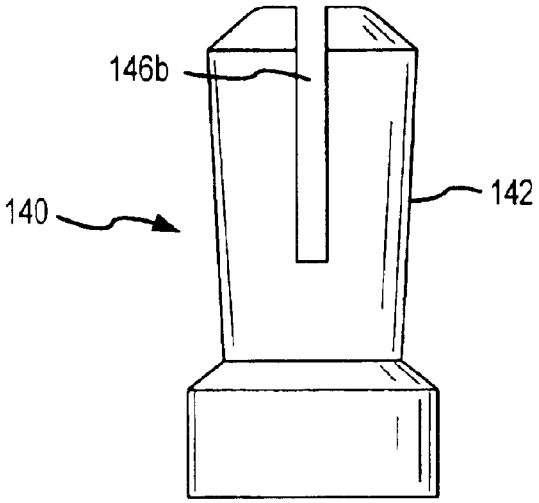
Figure 7B:
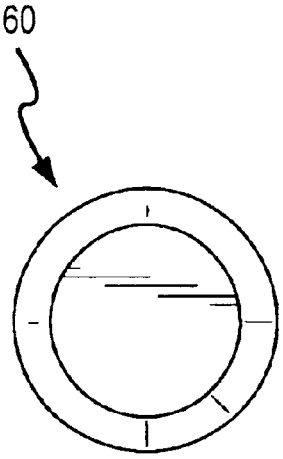
FIGS. 7A, 7B, 7C and 7D illustrate side, end, perspective and front views, respectively, of an additional fixation apparatus embodiment.
Figure 7C:
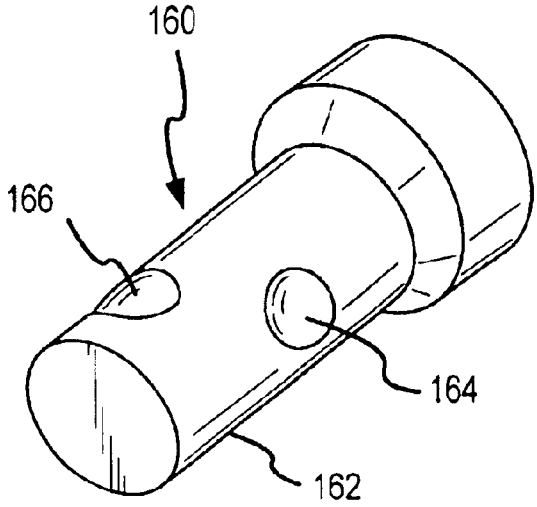
Figure 7A:
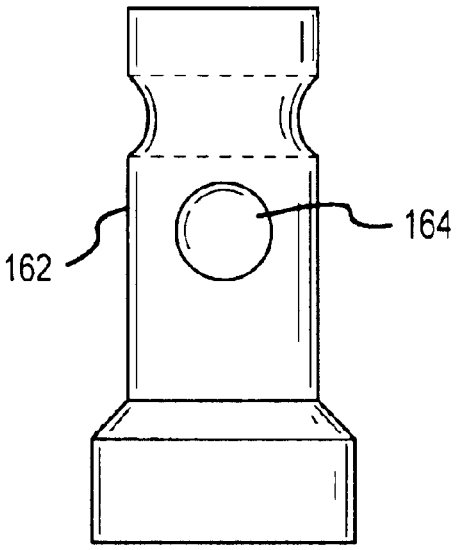
Figure 7D:
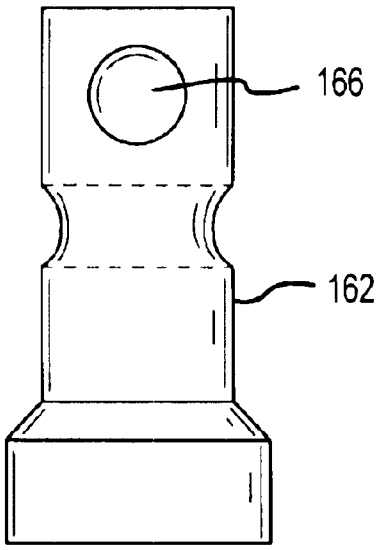
Figure 8B:
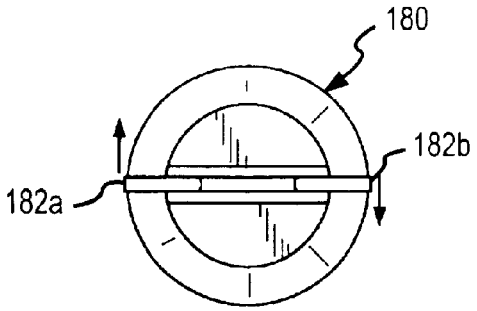
FIGS. 8A, 8B, 8C and 8D illustrate side, end, perspective and front views, respectively, of another fixation apparatus embodiment.
Figure 8C:
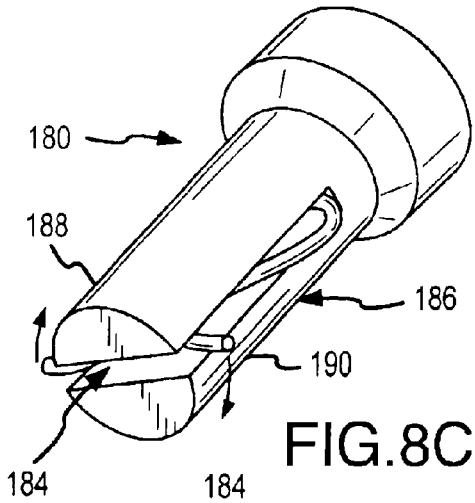
Figure 8A:
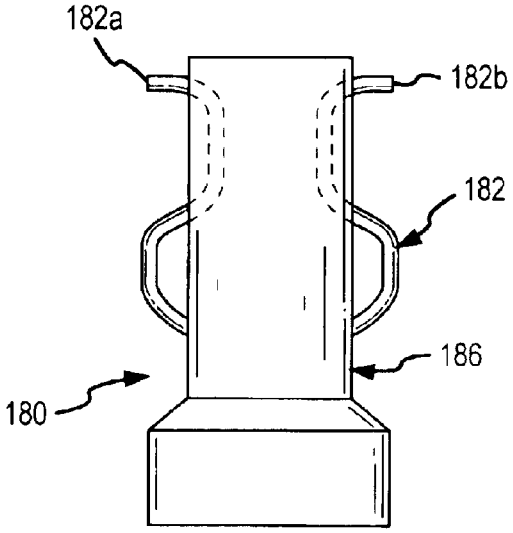
Figure 8D:
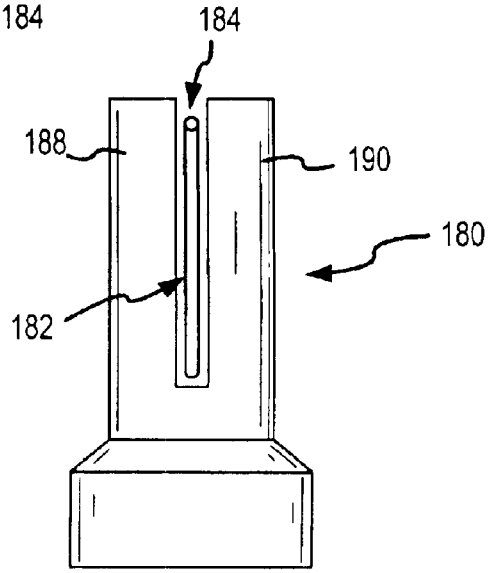

Another fixation apparatus embodiment 140 is shown in FIGS. 6A–6C. Fixation apparatus 140 includes body portion 142 divided into four leg portions 144*a*, 144*b*, 144*c* and 144*d* by transfer slots 146*a* and 146*b* which extend from the distal end of the main body portion 142 rearwardly. As shown best by FIG. 6A, the proximal outer surfaces of each of the leg members angle slightly away from the center axis. Further, tapered surfaces 148 are provided at the distal end of each of the leg members. By virtue of the illustrated configuration, the distal end of fixation apparatus 140 may be positioned in an ossicular opening and, as the fixation apparatus 140 is advanced, increased lateral loading may be achieved.

Referring now to FIGS. 7A–7D, yet another fixation apparatus embodiment 160 is illustrated. Fixation apparatus 160 comprises a body portion 162 having two openings 164, 166 defined therethrough at different locations along the length of the body portion 162. As will be appreciated, such openings 164, 166 also accommodate the in-growth of tissue after implantation.

In yet another approach, FIGS. 8A–8D illustrate a fixation apparatus embodiment 180 which utilizes a spring member 182 positioned within a slot 184 that extends rearwardly from the distal end of body portion 186. More particularly, the spring member 182 may comprise a shape memory alloy that is actuatable at bodily temperatures to change from a first configuration in which spring legs 182*a* and 182*b* are substantially positioned within a common plane to a second configuration in which the free ends of spring legs 182*a* and 182*b* move laterally away from the noted common plane. Upon such actuation, leg members 188, 190 are deflected outward to achieve lateral loading.

In addition to the above-noted alternate fixation apparatus embodiments, additional approaches are contemplated in which an outer collar or ring may be selectively advanced/retracted about the body portion of a fixation apparatus to deflect opposing leg members outward and thereby achieve lateral loading within an ossicular opening.

The description provided above is for the purpose of facilitating an understanding of the various features comprising the present invention and is not intended to limit the scope of protection. Additional embodiments, as well as modifications and extensions will be apparent to those skilled in the art and are intended to be within the scope of the present invention as defined by the claims presented.

What is claimed is:

1. A fixation apparatus for interconnection to a vibratory member of an implantable hearing aid actuator, comprising:

a proximal end for interconnection to a vibratory member of an implantable hearing aid actuator;

a distal end configured for location adjacent to a single side of an ossicular bone of a patient; and, a body portion extending between said proximal end and said distal end, wherein said body portion comprises at least one surface discontinuity, said at least one surface discontinuity being, adapted and located for inducing patient tissue attachment thereto, free from applying opposing compressive forces thereby, at an ossicular bone of a patient.

2. A fixation apparatus as recited in claim 1, wherein said at least one surface discontinuity comprises at least one of a complex surface shape, surface pores and surface asperities.

3. A fixation apparatus as recited in claim 2, wherein said at least one surface discontinuity comprises:

at least one hole extending crosswise through said body portion.

4. A fixation apparatus as recited in claim 2, wherein said at least one surface discontinuity comprises:

at least one pair of adjacent enlarged and reduced sections in said body portion, wherein a stepped-down lip is defined between said enlarged and reduced sections.

5. A fixation apparatus as recited in claim 4, wherein at least a distal one of said enlarged sections is of a frusto-conical configuration.

6. A fixation apparatus as recited in claim 2, wherein said at least one surface discontinuity includes:

a plurality of frusto-conical sections spaced along said body portion.

7. A fixation apparatus as recited in claim 2, wherein said at least one surface discontinuity comprises:

at least one slot extending across and rearwardly through said body portion from the distal end, wherein at least two leg members are defined.

8. A fixation apparatus as recited in claim 7, wherein said at least one surface discontinuity comprises two transverse slots extending across and rearwardly away from said distal end, wherein four leg members are defined.

9. A fixation apparatus as recited in claim 7, further comprising:

a selectively actuatable spring member positionable in said at least one slot, wherein said spring member comprises a shape memory material.

10. A fixation apparatus as recited in claim 7, wherein said body portion includes:

a first outer surface portion that tapers outwardly from said distal end.

11. A fixation apparatus as recited in claim 7, wherein said at least one discontinuity further comprises:

at least one pair of adjacent enlarged and reduced sections in said body portion, wherein a stepped-down lip is defined between said enlarged and reduced sections.

12. A fixation apparatus as recited in claim 7, wherein a first outer surface portion of each of said at least two leg members tapers outwardly from said distal end.

13. A fixation apparatus as recited in claim 12, wherein said at least two leg members are deflectable.

14. A fixation apparatus as recited in claim 12, wherein a second outer surface portion of each of said at least two leg members tapers inwardly from the corresponding first surface portion.

15. A fixation apparatus for interconnection to a vibratory member of an implantable hearing aid actuator, comprising:

a proximal end for interconnection to a vibrator member of an implantable hearing aid actuator:

a distal end for location adjacent to an ossicalar bone of a patient: and, a body portion extended between said proximal end and said distal end, wherein said body portion comprises at least one surface discontinuity adapted and located for inducing patient tissue attachment thereto at an ossicular bone of a patient, wherein said at least one surface discontinuity is defined by an outer surface having at least one of surface pores and surface asperities, and wherein said outer surface comprises a material selected from a group consisting of: a ceramic material, a plastic material, a composite ceramic material, and a composite plastic material.

16. A fixation apparatus as recited in claim 15, wherein said outer surface of said fixation apparatus comprises a material selected from a group consisting of:
hydroxyapatite and tricalcium phosphate.

17. A fixation apparatus for interconnection to a vibratory member of an implantable hearing aid actuator, comprising:

a proximal end for interconnection to a vibratory member of an implantable hearing aid actuator;

a distal end configured for location within an opening defined on a single side of an ossicular bone of a patient; and, a body portion extending between said proximal end and said distal end, wherein said body portion includes at least one slot extending across and rearwardly through a subportion of said body portion from said distal end, wherein at least two leg members are defined, and wherein said two leg members are adapted for inducing patient tissue attachment thereto, free from applying opposing compressive forces thereby, at an ossicular bone of a patient.

18. A fixation apparatus as recited in claim 17, wherein said subportion of said body portion has a modulus of elasticity in tension of at least about $1\times10^7$ psi.

19. A fixation apparatus as recited in claim 17, wherein said subportion of said body portion comprises a metal selected from a group consisting of:

titanium, a titanium alloy, platinum, a platinum alloy, gold-plated stainless steel.

20. A fixation apparatus as recited in claim 17, wherein said subportion of said body portion is selected to have a modulus of elasticity so that, during positioning of the fixation apparatus within an ossicular opening of a patient, a ratio between an applied axial force and a resultant lateral loading force is less than about ten to one.

21. A fixation apparatus as recited in claim 17, wherein a first outer surface portion of each said at least two leg members tapers outwardly from said distal end.

22. A fixation apparatus as recited in claim 21, wherein a cross dimension of said distal end is less than a cross dimension of said ossicular opening, and wherein a cross dimension across said first outer surface portions of said at least two leg members is greater than said cross dimension of said ossicular opening.

23. An implantable hearing aid actuator, comprising:

a transducer; and, an apparatus, responsive to said transducer to communicate axial vibrations to an ossicular chain of a patient, including: an end configured for location adjacent to single side of an ossicular bone of a patient; and, at least one surface discontinuity located and adapted for inducing patient tissue attachment thereto, free from applying opposing compressive forces thereby, at an ossicular bone of a patient.

24. An implantable hearing aid actuator as recited in claim 23, wherein said at least one surface discontinuity comprises:

at least one of a complex surface shape, surface pores and surface asperities.

25. An implantable hearing aid actuator as recited in claim 23, wherein said at least one surface discontinuity comprises:

at least one slot extending across and rearwardly through a body portion from a distal end of said apparatus, wherein at least two leg members are defined.

26. An implantable hearing aid actuator as recited in claim 25, wherein said at least two leg members are deflectable.

27. An implantable hearing aid actuator as recited in claim 25, wherein said at least one surface discontinuity comprises two transverse slots extending across and rearwardly away from said distal end, wherein four leg members are defined.

28. An implantable hearing aid actuator as recited in claim 25, further comprising:

a selectively actuatable spring member positionable in said at least one slot, wherein said spring member comprises a shape memory material.

29. An implantable hearing aid actuator as recited in claim 25, wherein said body portion includes:

a first outer surface portion that tapers outwardly from said distal end.

30. An implantable hearing aid actuator as recited in claim 25, wherein said at least one surface discontinuity further comprises:

at least one pair of adjacent enlarged and reduced sections in said body portion, wherein a stepped-down lip is defined between said enlarged and reduced sections.

31. An implantable hearing aid actuator as recited in claim 25, wherein a first outer surface portion of each of said at least two leg members tapers outwardly from said distal end.

32. An implantable hearing aid actuator as recited in claim 31, wherein a second outer surface portion of each of said at least two leg members tapers inwardly from the corresponding first outer surface portion.

33. An implantable hearing aid actuator as recited in claim 23, wherein said at least one surface discontinuity comprises:

at least one hole extending crosswise through a body portion of said apparatus.

34. An implantable hearing aid actuator as recited in claim 23, wherein said at least one surface discontinuity comprises:

at least one pair of adjacent enlarged and reduced sections in a body portion of said apparatus, wherein a stepped-down lip is defined between said enlarged and reduced sections.

35. An implantable hearing aid actuator as recited in claim 34, wherein at least a distal one of said enlarged sections is of a frusto-conical configuration.

36. An implantable hearing aid actuator as recited in claim 23, wherein said at least one surface discontinuity includes:

a plurality of frusto-conical sections spaced along a body portion of said apparatus.

37. An implantable hearing aid actuator as recited in claim 23, wherein said at least one surface discontinuity is defined by an outer surface having at least one of said surface pores and said surface asperities, and wherein said outer surface comprises a material selected from a group consisting of: a ceramic material, a plastic material, a composite ceramic material, and a composite plastic material.

38. An implantable hearing aid actuator as recited in claim 37, wherein said outer surface of said apparatus comprises a material selected from a group consisting of: hydroxyapatite and tricalcium phosphate.

39. An implantable hearing aid actuator as recited in claim 23, wherein said apparatus includes:

a vibratory member connected to and extending away from said transducer; and, a fixation apparatus interconnected to said vibratory member.

40. An implantable hearing aid actuator as recited in claim 39, wherein said at least one surface discontinuity is provided on said fixation apparatus.

41. A fixation apparatus for interconnection to a vibratory member of an implantable hearing aid actuator, comprising:

a proximal end for interconnection to a vibratory member of an implantable hearing aid actuator;

a distal end for location adjacent to an ossicular bone of a patient; and, a body portion extending between said proximal end, and said distal end, wherein said body portion comprises at least one surface discontinuity adapted and located for inducing patient tissue attachment thereto at an ossicular bone of a patient, wherein said at least one surface discontinuity comprises at least one slot extending across and rearwardly thorough said body portion from the distal ends, wherein at least two leg members are defined;

selectively actuable spring member positionable in said at least one slot, wherein said spring member comprises a shape memory material.

42. A fixation apparatus as recited in claim 41, wherein said at least two leg members are deflectable.

* * * * *

UNITED STATES PATENT AND TRADEMARK OFFICE

CERTIFICATE OF CORRECTION

PATENT NO. : 6,705,985 B2
DATED : March 16, 2004
INVENTOR(S) : Easter et al.

It is certified that error appears in the above-identified patent and that said Letters Patent is hereby corrected as shown below:

Column 3,
Line 30, delete the word “nickle”, and insert therefor -- nickel --.

Column 9,
Line 48,after the word “being”, delete “,”.

Column 10,
Line 38, delete the word “ossicalar”, and insert therefor -- ossicular --.

Column 12,
Line 51, after the word “end”, delete “,”.

Signed and Sealed this

Fifteenth Day of June, 2004

JON W. DUDAS
*Acting Director of the United States Patent and Trademark Office*